United States Patent [19]

Henzel

[11] Patent Number: 5,077,263

[45] Date of Patent: Dec. 31, 1991

[54] INTERMEDIATE RECEIVER RELEASE LAYER

[75] Inventor: Richard P. Henzel, Webster, N.Y.

[73] Assignee: Eastman Kodak Company, Rochester, N.Y.

[21] Appl. No.: 606,400

[22] Filed: Oct. 31, 1990

[51] Int. Cl.[5] ..... B41M 5/035; B41M 5/26

[52] U.S. Cl. ..... 503/227; 8/471; 428/195; 428/209; 428/913; 428/914

[58] Field of Search ..... 8/471; 428/195, 209, 428/913, 914

[56] References Cited

U.S. PATENT DOCUMENTS 4,923,848 5/1990 Akada et al. ..... 503/227

*Primary Examiner*—Bruce H. Hess

*Attorney, Agent, or Firm*—Andrew J. Anderson

[57] ABSTRACT

An intermediate receiving element comprising a metallic surface having thereon a polymeric dye image-receiving layer and a stripping layer between the metallic surface and the dye image-receiving layer, wherein the stripping layer comprises a mixture of a hydrophilic cellulosic material and a polyethyleneglycol.

20 Claims, No Drawings

INTERMEDIATE RECEIVER RELEASE LAYER

This invention relates to a thermal dye transfer process and intermediate receiver used therein for obtaining a color proof which is used to represent a printed color image obtained from a printing press, and more particularly to the use of a release or stripping layer in the intermediate receiver used in the process.

In order to approximate the appearance of continuous-tone (photographic) images via ink-on-paper printing, the commercial printing industry relies on a process known as halftone printing. In halftone printing, color density gradations are produced by printing patterns of dots of various sizes, but of the same color density, instead of varying the color density uniformly as is done in photographic printing.

There is an important commercial need to obtain a color proof image before a printing press run is made. It is desired that the color proof will accurately represent the image quality, details, color tone scale and, in many cases, the halftone pattern of the prints obtained on the printing press. In the sequence of operations necessary to produce an ink-printed, full-color picture, a proof is also required to check the accuracy of the color separation data from which the final three or more printing plates or cylinders are made. Traditionally, such color separation proofs have involved silver halide photographic, high-contrast lithographic systems or non-silver halide light-sensitive systems which require many exposure and processing steps before a final, full-color picture is assembled. U.S. Pat. No. 4,600,669 of Ng et al., for example, discloses an electrophotographic color proofing system.

In U.S. patent application 514,643, filed Apr. 25, 1990, of DeBoer, the disclosure of which is incorporated by reference, a thermal dye transfer process is described for producing a direct digital, halftone color proof of an original image. The proof is used to represent a printed color image obtained from a printing press. The process described therein comprises:

a) generating a set of electrical signals which is representative of the shape and color scale of an original image;

b) contacting a dye-donor element comprising a support having thereon a dye layer and an infrared-absorbing material with a first intermediate dye-receiving element comprising a support having thereon a polymeric, dye image-receiving layer;

c) using the signals to imagewise-heat by means of a diode laser the dye-donor element, thereby transferring a dye image to the first dye-receiving element; and d) retransferring the dye image to a second final dye image-receiving element which has the same substrate as the printed color image.

As set forth in U.S. Ser. No. 514,643 described above, an intermediate dye-receiving element is used with subsequent retransfer to a second receiving element to obtain the final color proof. This is similar to the electrophotographic color proofing system of Ng et al. referred to above, which discloses forming a composite color image on a dielectric support with toners and then laminating the color image and support to a substrate to simulate a color print expected from a press run. In both processes, the second or final receiving element can have the same substrate as that to be used for the actual printing press run. This allows a color proof to be obtained which most closely approximates the look and feel of the printed images that will be obtained in the actual printing press run. A multitude of different substrates can be used to prepare the color proof (the second receiver); however, there needs to be employed only one intermediate receiver.

For thermal dye transfer color proofing, the intermediate receiver can be optimized for efficient dye uptake without dye-smearing or crystallization. In the retransfer step, the dyes and receiver binder may be transferred together to the second receiver, or the dyes alone may be transferred where the second receiver is receptive to the dyes. Preferably, the dyes and receiver binder are transferred together to the final color proof receiver in order to maintain image sharpness and overall quality, which may be lessened when the dyes are retransferred alone to the final receiver. This is similar to the electrophotographic color proofing system of Ng et al. which discloses transferring a separable dielectric polymeric support layer together with the composite toner image from an electrophotographic element to the final receiver substrate.

Copending, commonly assigned U.S. Ser. No. 07/606,404 of Kaszczuk et al., the disclosure of which is incorporated by reference, discloses intermediate receivers for use in a thermal dye transfer color proofing system comprising a support, a dye image-receiving layer, and a metallic layer. The metallic layer is preferably between the support and the dye image-receiving layer, and serves to increase dye transfer efficiency and decrease image defects when using a laser energy source for the initial dye image transfer. Retransfer of the dyed image-receiving layer to the final receiver (color proof substrate) in such an arrangement requires that the image receiving layer be separable from the metallic layer.

Conventional cellulosic material release agents or stripping layers such as hydroxyethyl cellulose have been found to provide adequate releasibility between metallic surfaces and polymeric dye image-receiving layers under cool stripping conditions (e.g. room temperature 15°-25° C.), but these materials do not function well under hot stripping conditions (e.g. 100°-200° C., temperatures used for lamination of the polymeric dye image-receiving layer to the final receiver proof substrate). It would be desirable to provide releasibility between a polymeric receiving layer and a metallic surface under hot stripping conditions so that the intermediate receiver support and metal layer of intermediate receiving elements as disclosed in U.S. Ser. No. 07/606,404 referred to above may be stripped from the image-receiving layer immediately after it is laminated to the final receiver proof substrate without first having to cool the laminate.

These and other objects of the invention are achieved in accordance with the use of the intermediate receiving element of this invention which comprises a metallic surface bearing a polymeric dye image-receiving layer and a stripping layer between the metallic surface and the dye image-receiving layer, wherein the stripping layer comprises a mixture of a hydrophilic cellulosic material and a polyethyleneglycol.

The process of the invention comprises (a) forming a thermal dye transfer image in a polymeric dye image-receiving layer of an intermediate dye-receiving element by imagewise-heating a dye-donor element and transferring a dye image to the dye image-receiving layer, the intermediate dye receiving element comprising a metallic surface, the dye image-receiving layer, and a stripping layer between the metallic surface and the dye image-receiving layer, the stripping layer comprising a mixture of a hydrophilic cellulosic material and a polyethyleneglycol, (b) transferring the polymeric dye image-receiving layer to the surface of a final receiver element by adhering the dye image-receiving layer to the final receiver element, and (c) stripping the metallic surface from the dye image-receiving layer.

The hydrophilic cellulosic material is, for example, hydroxyethyl cellulose, carboxymethyl cellulose, methyl cellulose, methylhydroxyethyl cellulose, or methylhydroxypropyl cellulose. Equivalent results may be achieved with hydrophilic non-cellulosic materials such as polyvinylalcohol or polyvinylprrolidone.

Preferably, the polyethylene glycol has an average molecular weight of from about 500 to 10,000 to facilitate coating of the stripping mixture. Equivalent results may be achieved where materials such as hydrocarbon waxes, amide waxes, ester waxes, and low melting crystalline polymers such as polyethyleneoxide and polycaprolactone are substituted for the polyethyleneglycol.

The preferred weight ratio of hydrophilic cellulosic material to polyethylene glycol is from about 20:1 to about 1:1, most preferably from about 3:1 to about 1:1. The mixture is preferably coated at from about 0.05 to 1.5 g/m$^2$.

The intermediate dye receiving element metallic surface may be the surface of a metallic layer on a separate support, or may be the surface of a self-supporting metallic layer. Where a separate support is used, it may be a polymeric film such as a poly(ether sulfone), a polyimide, a cellulose ester such as cellulose acetate, a poly(vinyl alcohol-co-acetal) or a poly (ethylene terephthalate). In general, polymeric film supports of from 5 to 500 μm are used. Alternatively, a paper support may be used. Where a paper support is used, it is preferably resin coated to provide smoothness. The intermediate support thickness is not critical, but should provide adequate dimensional stability. Self supporting metallic layers may take the form of foils, sheets, etc.

The metallic surface of the intermediate element may comprise, for example, silver, aluminum, nickel, or any other desired metal. As set forth in U.S. Ser. No. 07/606,404 referred to above, the metallic surface is preferably diffuse and specularly reflective.

The dye image-receiving layer may comprise, for example, a polycarbonate, a polyurethane, a polyester, polyvinyl chloride, cellulose esters such as cellulose acetate butyrate or cellulose acetate propionate, poly(styrene-co-acrylonitrile), poly(caprolactone), polyvinyl acetals such as poly(vinyl alcohol-co-butyral), mixtures thereof, or any other conventional polymeric dye-receiver material provided it will adhere to the second receiver. The dye image-receiving layer may be present in any amount which is effective for the intended purpose. In general, good results have been obtained at a concentration of from about 0.2 to about 5 g/m$^2$.

The dye-donor element that is used in the process of the invention comprises a support having thereon a heat transferable dye-containing layer. The use of dyes in the dye-donor rather than pigments permits a wide selection of hue and color that enables a closer match to a variety of printing inks and also permits easy transfer of images one or more times to a receiver if desired. The use of dyes also allows easy modification of density to any desired level.

Any dye can be used in the dye-donor employed in the invention provided it is transferable to the dye-receiving layer by the action of the heat. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.); or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination.

In color proofing in the printing industry, it is important to be able to match the proofing ink references provided by the International Prepress Proofing Association. These ink references are density patches made with standard 4-color process inks and are known as SWOP (Specifications Web Offset Publications) Color References. For additional information on color measurement of inks for web offset proofing, see "Advances in Printing Science and Technology", Proceedings of the 19th International Conference of Printing Research Institutes, Eisenstadt, Austria, June 1987, J. T. Ling and R. Warner, p.55. Preferred dyes and dye combinations found to best match the SWOP Color References are the subject matter of copending, commonly assigned U.S. Ser. Nos. 07/606,398, 07/606,399, and 07/606,395 of Champann and Evans, the disclosures of which are incorporated by reference.

The dyes of the dye-donor element employed in the invention may be used at a coverage of from about 0.05 to about 1 g/m$^2$, and are dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U. S. Pat. No. 4,700,207; a polycarbonate; polyvinyl acetate; poly(styrene-co-acrylonitrile); a poly(sulfone); a polyvinylacetal such as poly(vinyl alcohol-co-butyral) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat needed to transfer the sublimable dyes. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 5 to about 200 μm. It may also be coated with a subbing layer, if desired, such as those materials described in U.S. Pat. Nos. 4,695,288 or 4,737,486.

The dye-donor elements employed in the invention may be used with various methods of heating in order to transfer dye to the intermediate receiver. For example, a resistive thermal head or a laser may be used.

When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material. The laser radiation is then absorbed into the dye layer and converted to heat by a molecular process known as internal conversion.

Lasers which can be used to transfer dye from dye-donors employed in the invention are available commercially. There can be employed, for example, Laser Model SDL-2420-H2 from Spectro Diode Labs, or Laser Model SLD 304 V/W from Sony Corp.

In the above process, multiple dye-donors may be used in combination to obtain as many colors as desired in the final image. For example, for a full-color image, four colors: cyan, magenta, yellow and black are normally used.

Thus, in a preferred embodiment of the process of the invention, a dye image is transferred by imagewise heating a dye-donor containing an infrared-absorbing material with a diode laser to volatilize the dye, the diode laser beam being modulated by a set of signals which is representative of the shape and color of the original image, so that the dye is heated to cause volatilization only in those areas in which its presence is required on the dye-receiving layer to reconstruct the color of the original image.

Spacer beads may be employed in a separate layer over the dye layer of the dye-donor in the above-described laser process in order to separate the dye-donor from the dye-receiver during dye transfer, thereby increasing its uniformity and density. That invention is more fully described in U.S. Pat. No. 4,772,582, the disclosure of which is hereby incorporated by reference. Alternatively, the spacer beads may be employed in or on the receiving layer of the dye-receiver as described in U.S. Pat. No. 4,876,235, the disclosure of which is hereby incorporated by reference. The spacer beads may be coated with a polymeric binder if desired.

In a further preferred embodiment of the invention, an infrared-absorbing dye is employed in the dye-donor element instead of carbon black in order to avoid desaturated colors of the imaged dyes from carbon contamination. The use of an absorbing dye also avoids problems of uniformity due to inadequate carbon dispersing. For example, cyanine infrared absorbing dyes may be employed as described in DeBoer U.S. patent application Ser. No. 463,095, filed Jan. 10, 1990, the disclosure of which is hereby incorporated by reference. Other materials which can be employed are described in the following 07/ series U.S. patent application Ser. Nos.: 366,970, 367,062, 366,967, 366,968, 366,969, 367,064, 367,061, 369,494, 366,952, 369,493, 369,492, and 369,491.

A thermal printer which uses the laser described above to form an image on a thermal print medium is described and claimed in copending U.S. patent application Ser. No. 451,656 of Baek and DeBoer, filed Dec. 18, 1989, the disclosure of which is hereby incorporated by reference.

As noted above, a set of electrical signals is generated which is representative of the shape and color of an original image. This can be done, for example, by scanning an original image, filtering the image to separate it into the desired basic colors (red, blue and green), and then converting the light energy into electrical energy. The electrical signals are then modified by computer to form the color separation data which is used to form a halftone color proof. Instead of scanning an original object to obtain the electrical signals, the signals may also be generated by computer. This process is described more fully in Graphic Arts Manual, Janet Field ed., Arno Press, New York 1980 (p. 358ff), the disclosure of which is hereby incorporated by reference.

The dye-donor element employed in the invention may be used in sheet form or in a continuous roll or ribbon. If a continuous roll or ribbon is employed, it may have alternating areas of different dyes or dye mixtures, such as sublimable cyan and/or yellow and/or magenta and/or black or other dyes. Such dyes, for example, are disclosed in the co-pending applications referred to above.

As noted above, after the dye image is obtained on a first intermediate dye-receiving element, it is retransferred to a second or final receiving element in order to obtain a final color image. For color proofs, the final receiving element comprises a paper substrate. The substrate thickness is not critical and may be chosen to best approximate the prints to be obtained in the actual printing press run. Examples of substrates which may be used for the final receiving element (color proof) include the following: Adproof® (Appleton Paper), Flo Kote Cove® (S. D. Warren Co.), Champion Textweb® (Champion Paper Co.), Quintessence Gloss® (Potlatch Inc.), Vintage Gloss® (Potlatch Inc.), Khrome Kote® (Champion Paper Co.), Consolith Gloss® (Consolidated Papers Co.) and Mountie Matte® (Potlatch Inc.).

A dye migration barrier layer, such as a polymeric layer, may be applied to the final receiver color proof paper substrate before the dyed image-receiving layer is laminated thereto. Such barrier layers help minimize any dye smear which may otherwise occur and are the subject matter of copending, commonly assigned U.S. Ser. No. 07/606,408 of Chapman et al, the disclosure of which is incorporated by reference.

The imaged, intermediate dye image-receiving layer may be transferred to the final receiver (color proof substrate), for example, by passing the intermediate and final receiver elements between two heated rollers, use of a heated platen, use of a resistive thermal head, use of other forms of pressure and/or heat, external heating, etc., to form a laminate with the imaged intermediate dye image-receiving layer adhered to the final receiver. The metallic surface (metallic layer and separate intermediate support, if present) is separated from the dye-image receiving layer after it is laminated to the paper substrate. A release or stripping layer as described above is included between the metallic surface and dye image-receiving layer to facilitate separation under hot stripping conditions.

The following examples are provided to illustrate the invention.

EXAMPLES

An intermediate dye-receiving element was prepared by coating the following layers in order on an 100 μm thick unsubbed poly(ethylene terephthalate) support:

1) A layer of metallic aluminum to a coverage of 0.16 μm by vacuum deposition using an aluminum source and standard electron beam deposition techniques as described by Maisel and Glang, ed. "Handbook of Thin Film Technology," McGraw-Hill Publ. Co.,1983.

2) A stripping layer of either hydroxyethyl cellulose (Natrosol ® 250LR, Aqualon Co.) (0.22 or 0.43 g/m$^2$), or carboxymethyl cellulose (as the sodium salt) (grade 7HS, Aqualon Co.)(0.11 or 0.22 g/m$^2$), and polyethylene glycol (of average mole wt. 8000) (Kodak Laboratory Chemicals)(0.05 to 0.43 g/m$^2$) coated from water. This layer also contained a nonylphenol-glycidol surfactant (10G, Olin Corp.) (0.01 g/m$^2$).

3) A dye-receiving layer of cross-linked poly(styrene-co-divinylbenzene) beads (12 micron average diameter)(0.11. g/m$^2$) in a poly(vinyl alcohol-co-butyral) binder (Butvar ® B-76, Monsanto Co.) (4.0g/m$^2$) coated from a butanone and cyclopentanone solvent mixture.

Comparison intermediate receivers were prepared as described above except that stripping layer (2) contained no polyethylene glycol.

Each intermediate receiver was laminated to Quintessence Gloss ® (Potlatch Co.) 80 pound paper stock by passage through a pair of pressure rollers heated to 120° C. The poly(ethylene terephthalate) support with metal layer was then manually peeled away from the polymeric receiving layer laminate on the paper stock. Two peel conditions were used: one peel was done immediately after passage through the rollers (hot peel); the other peel was done after the laminate was cooled to room temperature (cool peel). After separation and discarding the support with metal layer, the surface of the intermediate receiving layer was examined for surface defects. The peel should be easy and smooth, and deforming wrinkles and defects must be avoided. The following results were obtained (TABLE I):

TABLE I

| STRIPPING LAYER (g/m$^2$) | | STRIPPING PERFORMANCE | |
|---|---|---|---|
| Cellulosic | PEG | Hot Peel | Cool Peel |
| HEC (0.22) | None (control) | X | E |
| HEC (0.22) | (0.05) | E | E |
| HEC (0.22) | (0.11) | E | E |
| HEC (0.22) | (0.22) | E | E |
| HEC (0.43) | None (control) | X | E |
| HEC (0.43) | (0.11) | E | E |
| HEC (0.43) | (0.22) | E | E |
| HEC (0.43) | (0.43) | E | E |
| CMC (0.11) | None (control) | X | F |
| CMC (0.11) | (0.05) | E | E |
| CMC (0.11) | (0.11) | E | E |
| CMC (0.22) | None (control) | X | F |
| CMC (0.22) | (0.11) | E | E |
| CMC (0.22) | (0.22) | E | E |

E - Excellent peel - little effort required, no observable surface deformation.
F - Fair peel - some effort required, some surface deformation.
X - Could not separate, layers fused together and paper support tore upon separation.

The data above show that the addition of a polyethlene glycol (PEG) to carboxymethyl cellulose (CMC) and hydroxyethyl cellulose (HEC) significantly improves the stripping performance at the interface between a polymeric layer and a metal layer.

The invention has been described in detail with particular reference to preferred embodiments thereof, but it will be understood that variations and modifications can be effected within the spirit and scope of the invention.

What is claimed is:

1. A process for forming a color image comprising:

(a) forming a thermal dye transfer image in a polymeric dye image-receiving layer of an intermediate dye-receiving element comprising a metallic surface having thereon said dye image-receiving layer by imagewise-heating a dye-donor element and transferring a dye image to the dye image-receiving layer, (b) transferring the polymeric dye image-receiving layer to the surface of a final receiver element by adhering the dye image-receiving layer to the final receiver element, and (c) stripping the metallic surface from the dye image-receiving layer, wherein the intermediate dye receiving element further comprises a stripping layer between the metallic surface and the dye image-receiving layer, said stripping layer comprising a mixture of a hydrophilic cellulosic material and a polyethyleneglycol.

2. The process of claim 1 wherein the cellulosic material is hydroxyethyl cellulose, carboxymethyl cellulose, methyl cellulose, methylhydroxyethyl cellulose, or methylhydroxypropyl cellulose.

3. The process of claim 2 wherein the polyethylene glycol has an average molecular weight of from about 500 to about 10,000.

4. The process of claim 3 wherein the cellulosic material is hydroxyethyl cellulose or carboxymethyl cellulose.

5. The process of claim 3 wherein the weight ratio of cellulosic material to polyethylene glycol is from about 20:1 to about 1:1.

6. The process of claim 5 wherein the ratio is from about 3:1 to about 1:1.

7. The process of claim 1 wherein the weight ratio of cellulosic material to polyethylene glycol is from about 20:1 to about 1:1.

8. The process of claim 7 wherein the ratio is from about 3:1 to about 1:1.

9. The process of claim 1 wherein the metallic surface is the surface of a metallic layer on an intermediate support.

10. The process of claim 1 wherein step (a) comprises (i) generating a set of electrical signals which is representative of the shape and color scale of an original image, (ii) contacting a dye-donor element comprising a support having thereon a dye layer and an infrared-absorbing material with an intermediate dye-receiving element comprising a metallic surface having thereon the polymeric dye image-receiving layer, and (iii) using the signals to imagewise-heat by means of a diode laser the dye-donor element, thereby transferring a dye image to the intermediate dye image-receiving layer.

11. An intermediate dye-receiving element comprising a metallic surface, a dye image-receiving layer, and a stripping layer between the metallic surface and the dye image-receiving layer, said stripping layer comprising a mixture of a hydrophilic cellulosic material and a polyethyleneglycol.

12. The element of claim 11 wherein the cellulosic material is hydroxyethyl cellulose, carboxymethyl cellulose, methyl cellulose, methylhydroxyethyl cellulose, or methylhydroxypropyl cellulose.

13. The element of claim 12 wherein the cellulosic material is hydroxyethyl cellulose or carboxymethyl cellulose.

14. The element of claim 13 wherein the polyethylene glycol has an average molecular weight of from about 500 to about 10,000.

15. The element of claim 14 wherein the weight ratio of cellulosic material to polyethylene glycol is from about 20:1 to about 1:1.

16. The element of claim 15 wherein the ratio is from about 3:1 to about 1:1.

17. The element of claim 11 wherein the weight ratio of cellulosic material to polyethylene glycol is from about 20:1 to about 1:1.

18. The element of claim 17 wherein the ratio is from about 3:1 to about 1:1.

19. The element of claim 11 wherein the metallic surface is the surface of a metallic layer on an intermediate support.

20. The element of claim 11 wherein the polymeric dye image-receiving layer comprises a poly(vinyl alcohol-co-butyral).

* * * * *